US009005520B2

(12) United States Patent
Petelot et al.

(10) Patent No.: US 9,005,520 B2
(45) Date of Patent: Apr. 14, 2015

(54) STEEL COMPOSITIONS FOR SPECIAL USES

(75) Inventors: Daniel Petelot, Taisnieres en Thierache (FR); Annie Fouquet, legal representative, Taisnieres en Thierache (FR); Catheline Petelot, legal representative, Taisnieres en Thierache (FR); Emilie Petelot, legal representative, Taisnieres en Thierache (FR); Adeline Petelot, legal representative, Taisnieres en Thierache (FR); Jean Leyer, Valenciennes (FR); Bruno Vandenberghe, Onnaing (FR); Viviane Lepingle, Corbehem (FR); Ghislain Louis, Chateau l'Abbaye (FR)

(73) Assignees: V & M France, Boulogne-Billancourt (FR); Annie Fouquet, Taisnieres en Thierache (FR); Catheline Petelot, Taisnieres en Thierache (FR); Emilie Petelot, Taisnieres en Thierache (FR); Adeline Petelot, Taisnieres en Thierache (FR)

( * ) Notice: Subject to any disclaimer, the term of this patent is extended or adjusted under 35 U.S.C. 154(b) by 1125 days.

(21) Appl. No.: 12/303,764

(22) PCT Filed: Jun. 7, 2007

(86) PCT No.: PCT/FR2007/000941
§ 371 (c)(1),
(2), (4) Date: Apr. 14, 2009

(87) PCT Pub. No.: WO2007/141427
PCT Pub. Date: Dec. 13, 2007

(65) Prior Publication Data

US 2010/0307430 A1 Dec. 9, 2010

(30) Foreign Application Priority Data

Jun. 9, 2006 (FR) ..... 06 05133

(51) Int. Cl.
*C22C 38/22* (2006.01)
*C22C 38/44* (2006.01)
(Continued)

(52) U.S. Cl.
CPC ..... *C22C 38/02* (2013.01); *C22C 38/04* (2013.01); *C22C 38/22* (2013.01); *C22C 38/44* (2013.01); *Y10S 148/909* (2013.01)

(58) Field of Classification Search
USPC ..... 420/105, 114; 148/333, 334
See application file for complete search history.

(56) References Cited

U.S. PATENT DOCUMENTS 4,381,940 A * 5/1983 Watanabe et al. ..... 420/106
5,573,605 A 11/1996 Bendick et al.

(Continued)

FOREIGN PATENT DOCUMENTS

EP 0 787 813 8/1997
EP 0 816 523 1/1998

(Continued)

OTHER PUBLICATIONS

English-hand translation of Japanese patent 363076854 A, Sasaki, Apr. 7, 1988.*

(Continued)

*Primary Examiner* — Deborah Yee
(74) *Attorney, Agent, or Firm* — Oblon, McClelland, Maier & Neustadt, L.L.P.

(57) ABSTRACT

The invention concerns steels having excellent resistance over time, in a corrosive atmosphere due to oxidizing environments such as, for example, fumes or water vapor, under high pressure and/or temperature. The invention concerns a steel composition for special applications, said composition containing, by weight, about 1.8 to 11% of chromium (and preferably between about 2.3 and 10% of chromium), less than 1% of silicon, and between 0.20 and 0.45% of manganese. It has been found that it is possible to adjust the contents of the composition based on a predetermined model, selected to obtain substantially optimal properties with respect to corrosion in specific conditions of high temperature performances. Said model can involve as additive of as residue at least one element selected among molybdenum, tungsten, cobalt, and nickel.

8 Claims, 5 Drawing Sheets

(51) Int. Cl.
*C22C 38/02* (2006.01)
*C22C 38/04* (2006.01)

(56) References Cited

U.S. PATENT DOCUMENTS

| | | | | |
|---|---|---|---|---|
| 5,746,843 | A | 5/1998 | Miyata et al. | |
| 5,814,274 | A | 9/1998 | Komai et al. | |
| 5,945,064 | A | 8/1999 | Komai et al. | |
| 6,358,336 | B1 * | 3/2002 | Miyata | 148/328 |
| 6,379,611 | B1 | 4/2002 | Komai et al. | |
| 2001/0035235 | A1 | 11/2001 | Kawano | |

FOREIGN PATENT DOCUMENTS

| | | | |
|---|---|---|---|
| EP | 0 870 573 | | 10/1998 |
| EP | 1 081 244 | | 3/2001 |
| EP | 1 143 026 | | 10/2001 |
| JP | 57-5849 | | 1/1982 |
| JP | 61-067757 | | 4/1986 |
| JP | 63-76854 | * | 4/1988 |
| JP | 2-217438 | | 8/1990 |
| JP | 2 217483 | | 8/1990 |
| JP | 3-53045 | * | 3/1991 |
| JP | 05043986 | A | 2/1993 |
| JP | 06-002038 | | 1/1994 |
| JP | 09-279242 | | 10/1997 |
| JP | 10-46290 | | 2/1998 |
| JP | 10-212520 | | 8/1998 |
| JP | 11-61342 | | 3/1999 |
| JP | 2001-271141 | | 10/2001 |
| JP | 2002-69588 | | 3/2002 |
| JP | 2002-194485 | | 7/2002 |
| JP | 2003-64449 | | 3/2003 |
| JP | 2003105506 | A | 4/2003 |
| SU | 773130 | | 9/1978 |
| SU | 857293 | | 12/1978 |
| WO | WO/02081766 | | 10/2002 |
| WO | 2004/072308 | A2 | 8/2004 |

OTHER PUBLICATIONS

Key to Steels, Verlag Stahlschlussel, West Germany, 1974.*

Machine-English translation of Japanese patent 2005-131688, Tanaka Masato, May 26, 2005.*

C J, Vaillant et al., "T/P23,24, 911 and 92: New grades for advanced coal-fired power plants—Properties and experience", CA Conference Article, vol. 2005, p. 1, XP002416389, 2007, (English abstract only).

J.C., Vaillant et al., "T/P23, 24, 911 and 92: New Grades for Advanced Coal-Fired Power Plants—Properties and Experience", Proceedings—ECCC Creep Conference, Creep and Frac, vol. 2005, pp. 87-98, XP009077512, (2005).

Bendick, W. et al., "New low alloy heat resistant ferritic steels T/P23 and T/P24 for power plant application", International Journal of Pressure Vessels and Piping, Elsevier, vol. 84, No. 1-2, pp. 13-20, (2007).

Bendick W. et al., "Neue Werkstoffentwicklungen Fuer moderne Hochleistungskraftwerke (New Material Developments for Modern High-capacity Power Plants", VGB Powertech, vol. 84, No. 7, pp. 82-88, XP001200573, 2004, (with English abstract).

Lepingle, V. et al., "Steam Corrosion Resistance of New 12% Cr Ferritic Boiler Steels", Materials Science Forum, vols. 461-464, pp. 1039-1046, XP002468481, (2004).

Brozda, J "New generation creep-resistant steels, their weldability and properties of welded joints: T/P92 Steel", Welding International, vol. 19, No. 1, pp. 5-13, (2005).

Brozda, J et al., "An investigation into the properties of the heat affected zone simulated in 9Cr-1 Mo—Nb, V(P91) steel intended for service at elevated temperatures", 2390 Welding International, vol. 9, No. 12, pp. 929-940, XP 000538256, (1995).

J. Zurek, et al., Materials ScienceForum vols. 461-464 (2004) pp. 791-798, "Effect of Alloying Additions in Ferritic 9-12%Cr Steels on the Temperature Dependence of the Steam Oxidation Resistance".

S. Osgerby, et al., Proceedings from the Fourth International Conference on Advances in Materials Technology for Fossil Power Plants, Oct. 25-28, 2004, Hilton Head Island, South Carolina. Copyright © 2005, "Assessment of the Steam Oxidation Behaviour of High Temperature Plant Materials".

* cited by examiner

| Rep | elements % | | | | | | | | | | | | | | | | Vcor |
|---|---|---|---|---|---|---|---|---|---|---|---|---|---|---|---|---|---|
| | C | Mn | P | S | Si | Cr | Mo | W | V | Nb | Ni | Al | N | B | Co | Cu | mes. |
| T23 | 0,1 | 0,48 | 0,01 | NA | 0,24 | 2,07 | 0,1 | 1,54 | 0,26 | 0,05 | 0,05 | 0,02 | NA | NA | NA | NA | 1,427 |
| T22 | 0,15 | 0,46 | 0,014 | NA | 0,23 | 2,06 | 1 | 0,014 | 0,008 | 0,004 | 0,15 | 0,019 | NA | NA | NA | NA | 1,035 |
| T91 | 0,1 | 0,46 | 0,016 | 0,002 | 0,31 | 8,73 | 0,99 | 0,01 | 0,22 | 0,08 | 0,26 | 0,02 | NA | NA | NA | NA | 0,094 |
| X20T | 0,18 | 0,52 | 0,02 | 0,003 | 0,25 | 10,98 | 0,93 | 0,02 | 0,26 | 0,007 | 0,37 | 0,015 | NA | NA | NA | NA | 0,116 |
| C | 0,16 | 0,53 | 0,006 | 0,001 | 0,09 | 11,25 | 1,46 | NA | 0,25 | 0,047 | 0,26 | 0,012 | 0,063 | NA | 0,9 | NA | 0,104 |
| T92 | 0,13 | 0,41 | 0,017 | NA | 0,22 | 8,91 | 0,44 | 1,69 | 0,21 | 0,09 | 0,13 | 0,003 | NA | NA | NA | NA | 0,113 |
| T122 | 0,14 | 0,52 | 0,02 | NA | 0,19 | 11,44 | 0,6 | 1,54 | 0,3 | 0,07 | 0,36 | 0,008 | NA | NA | NA | NA | 0,114 |
| B | 0,18 | 0,51 | 0,012 | 0,001 | 0,1 | 11,54 | 1,48 | NA | 0,26 | 0,058 | 0,25 | 0,01 | 0,047 | NA | NA | NA | 0,081 |
| E | 0,12 | 0,49 | 0,009 | 0,001 | 0,1 | 11,14 | 1,48 | NA | 0,25 | 0,057 | 0,26 | 0,011 | 0,045 | 0,006 | 3,02 | NA | 0,078 |
| Glab | 0,16 | 0,5 | 0,009 | 0,001 | 0,1 | 11,44 | 1,46 | NA | 0,25 | 0,044 | 0,27 | 0,006 | 0,05 | 0,0081 | 1,49 | NA | 0,087 |
| Gindus | 0,14 | 0,48 | 0,017 | 0,001 | 0,31 | 11,45 | 1,38 | 0,054 | 0,26 | 0,046 | 0,19 | 0,004 | 0,068 | 0,0051 | 1,42 | NA | 0,075 |
| 13Cr | 0,21 | 0,47 | 0,02 | NA | 0,25 | 12,7 | 0,064 | NA | 0,054 | 0,002 | 0,13 | 0,009 | NA | NA | NA | NA | 0,020 |
| X20U | 0,2 | 0,41 | 0,019 | 0,002 | 0,34 | 11,68 | 1,17 | 0,05 | 0,35 | 0,007 | 0,42 | 0,009 | NA | NA | NA | NA | 0,026 |
| Findus | 0,11 | 0,36 | 0,017 | 0,001 | 0,47 | 11,49 | 0,28 | 1,43 | 0,28 | 0,049 | 0,29 | 0,008 | 0,061 | 0,0046 | 1,48 | NA | 0,039 |
| VM12 | 0,11 | 0,336 | 0,014 | 0,003 | 0,456 | 11,39 | 0,257 | 1,466 | 0,26 | 0,045 | 0,271 | 0,01 | 0,051 | 0,0042 | 1,587 | 0,05 | 0,052 |
| F lab | 0,11 | 0,2 | 0,013 | 0,002 | 0,45 | 11,5 | 0,28 | 1,4 | 0,24 | 0,065 | 0,23 | 0,015 | 0,056 | 0,003 | 1,3 | NA | 0,013 |

Figure 4

STEEL COMPOSITIONS FOR SPECIAL USES

CROSS-REFERENCE TO RELATED APPLICATION

The present application is a National State (371) of PCT/FR07/00941, filed Jun. 7, 2007, which claims priority to French application no. 0605133, filed Jun. 9, 2006.

BACKGROUND OF THE INVENTION

1. Field of the Invention

The invention relates to a new steel composition for special uses, in particular displaying high performance in the presence of corrosion due to oxidising environments such as, for example, fumes or water vapour, under elevated pressure and/or temperature.

2. Description of Related Art

Atmospheres of elevated pressure and temperature in the presence of water vapour exist in particular in the industrial production of electricity. The generation, conditioning (in particular superheated and re-superheated) and transportation of the water vapour take place using steel elements, in particular seamless tubes. Despite a long history of solutions envisaged or implemented, which history will be returned to hereinafter, serious problems remain in terms of resistance in the atmosphere in question, and also over time.

These problems are particularly difficult to solve, in particular due to the significant variability of the properties of the steels as a function of their constituents, and to the awkwardness of the hot corrosion tests over a long period.

The term "corrosion" or "hot corrosion" will be used hereinafter to designate the phenomena of the loss of metal by hot oxidation.

The present invention seeks to improve the situation.

BRIEF SUMMARY OF THE INVENTION

The invention proposes a steel composition for special applications that is situated in the area comprising, in terms of content by weight, about 1.8 to 11% of chromium (and preferably between about 2.3 and 10% of chromium), less than 1% of silicon, and between 0.20 and 0.45% of manganese. It has been found that it is possible to adjust the contents of the composition based on a predetermined model, selected to obtain substantially optimum corrosion properties under given conditions for high-temperature performance. This model can deploy as an addition or as a residual at least one element selected from molybdenum, tungsten, cobalt, and nickel.

More particularly, the composition comprises a content by weight of silicon of between about 0.20 and 0.50%, preferably between about 0.30 and 0.50%. It can also comprise a content by weight of manganese of between about 0.25 and 0.45%, and more preferably between about 0.25 and 0.40%.

According to another aspect of the invention, said model comprises at least one contribution term of chromium, and a contribution term of manganese alone. The contribution term of manganese alone can comprise a second-degree polynomial function of the manganese content. The contribution term of chromium can comprise an inverse quadratic term of the chromium content, and an inverse term of an amount containing the chromium content.

According to preferential embodiments which will be described in greater detail hereinafter:

the steel composition comprises between about 2.3 and 2.6% by weight of chromium;

the steel composition comprises between about 8.9 and 9.5% to 10% by weight of chromium.

The invention also covers a seamless tube or the accessory thereof, basically consisting of a proposed steel composition, the application of the steel composition to seamless and accessory tubes, intended to generate, to convey or to condition water vapour under elevated pressure and temperature, and also the described technology for optimising the properties of the special steel compositions, in particular for the application thereof to seamless and accessory tubes, intended to generate, to convey or to condition water vapour under elevated pressure and temperature.

BRIEF DESCRIPTION OF THE SEVERAL VIEWS OF THE DRAWING(S)

Other features and advantages of the invention will become clearer on reading the following detailed description given with reference to the appended drawings, in which:

FIG. 4 is a table of steel compositions, on which long-term corrosion measurements at 650° C. have been carried out, which appear in the last column of the table;

Figure 1:
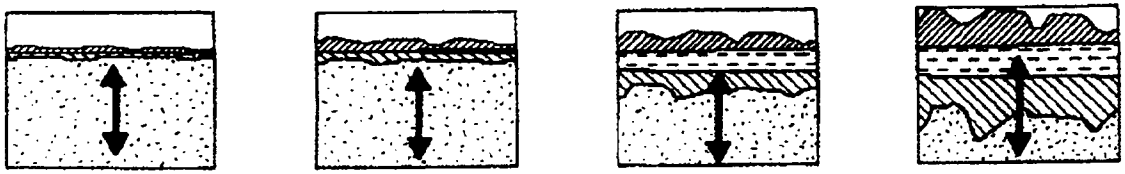
FIG. 1 illustrates schematically the development over time of a first oxidation mechanism, referred to in the present document as the "type-1" mechanism.

The drawings, the following description and its annexes contain, for the most part, elements whose nature is established. They may therefore not only serve to improve understanding of the present invention, but also contribute to the definition thereof, if appropriate.

DETAILED DESCRIPTION OF THE INVENTION

The conditions under which the invention may be carried out will now be examined.

Consideration will be given for example to the case of a fossil fuel thermal power station comprising a power boiler delivering superheated water vapour to a steam turbine coupled to an alternator. The good heat output of this type of thermal power stations is known; efforts are also being made increasingly to reduce the pollution caused by such stations, by limiting the emission both of fumes and of noxious gases such as $SO_2$, $NO_x$ and $CO_2$, the latter being more particularly responsible for the greenhouse effect. Now, the reduction in the relative amount of $CO_2$ produced during the combustion is achieved by way of the increase in the output of the boiler, which is linked to the temperature and to the pressure of the steam delivered to the turbine.

As the water vapour is basically confined in seamless steel tubes, efforts have been made for a number of years to improve the properties of the tubes for long-term resistance to the internal high-temperature fluid pressure by improving the creep strength of the tubes and in particular their creep rupture strength over 100,000 hours.

The group known as the American Society for Testing and Materials ("ASTM") has drawn up standards or specifications on which persons skilled in the art draw in order to select their steels. With regard to special steels for high-temperature use, these are:

the specification A213, entitled "Standard Specification for Seamless Ferritic and Austenitic Alloy-Steel Boiler, Superheater and Heat-Exchanger Tubes", and the specification A335: "Standard Specification for Seamless Ferritic Alloy-Steel Pipe for High-Temperature Service".

The boilers of the 1960s used non-alloy steels for the screen panels of the boiler and 2.25% Cr and 1% Mo grades (ASTM A213 T22 and ASTM A335 P22 grades) for the hot parts of the superheater tubes and the superheated steam conduits (160 bar-560° C.).

18% Cr and 10% Ni austenitic stainless steels intrinsically have better creep strength properties than the less highly alloyed grades having a ferritic structure but have serious drawbacks owing to the fact that a single boiler then has to comprise some steel parts having an austenitic structure and others having a ferritic structure: this ensues on the one hand from the differences in coefficients of thermal expansion and on the other hand from the necessity of producing welded joints between tubes of differing metallurgical structure.

There has therefore been a tendency to improve materials having a ferritic structure.

X 20 Cr Mo V 12-1 steel with 12% Cr in accordance with German standard DIN 17.175 is no longer very fashionable as its use is very awkward and its creep properties have been surpassed.

The 1980s saw the appearance in the standards of microalloyed 9% Cr grades (T91 and P91, T92 and P92 in accordance with ASTM A213 and A335) having both good creep strength and excellent use properties.

Similarly, there appeared in the 1990s microalloyed 2.25% Cr grades (T23, P23, T24, P24) to improve the performance of the screen panels and/or of specific parts of the superheaters.

Problems then arose with respect to resistance to hot oxidation, in particular in the case of 9% Cr steels compared to X 20 Cr Mo V 12-1 steel containing 12% Cr. Indeed, Cr and also Si and Al are known to be elements which reduce hot oxidation.

The term "hot oxidation" covers 2 types of phenomena:

oxidation by oxidising fumes, and oxidation by water vapour.

Oxidation on the Outer Surface of the Tubes

The phenomena of oxidation by oxidising fumes occur on the outside of the tubes and more particularly on the outside of the tubes of superheaters in view of the streams of fumes passing through these tubes.

They result in a loss of metal thickness and accordingly in an increase in the tangential stress $\sigma$ in the tube which may be written in terms of appended Equation [11], wherein D is the outer diameter, e is the thickness and P the internal steam pressure inside the tubes.

The thinner the oxide (or mill scale) layer, the more rapid the oxidation kinetics. These might therefore be considered to limit themselves as the mill scale layer grows. Unfortunately, when the mill scale layer is thick, it loses adhesion and becomes detached in sheets (exfoliation). As a result, oxidation resumes at great speed at the location where the metal is bare.

A metal which has slow oxidation kinetics and is capable of forming fine and adhesive mill scales is therefore highly desirable.

Oxidation on the Inner Surface of the Tubes

The same applies for other reasons to the phenomena of oxidation by water vapour which are found within the tubes and which have been studied more recently. Indeed, the mill scale formed inside the tubes of superheaters provides heat insulation between the fumes (heat source) and the water vapour to be superheated. And a thick mill scale on the steam side (inside of the tube) results in a more elevated temperature of the metal than when the mill scale is thin. Now, the negative influence of the temperature on the creep strength is exponential.

With identical creep strength properties, a steel tube which is resistant to oxidation by steam can therefore superheat the steam to a higher temperature than a steel tube which is less resistant to oxidation by steam.

Furthermore, in the case of mill scale which is thick and/or displays little adhesion, exfoliation thereof can have the following consequences:

in the case of the tubes of superheaters, an accumulation of the exfoliated mill scale in the pins of the coils of superheaters, which impedes the movement of steam and can cause bursting of superheater tubes as a result of catastrophic superheating;

entrainment of the exfoliated mill scale, issuing both from the superheater tubes and from the steam collectors or steam conduits, in the blades of the turbine with a risk of erosion and/or abrasion and destruction thereof.

PRIOR ART

For the time being, the boiler calculation codes do not take precise account of the properties for resistance to hot oxidation (use is made of empirical rules defining in an excessively pessimistic manner an excess thickness for hot oxidation both by fumes and by water vapour).

Approach of the Applicant

In WO 02/081766, the Applicant proposed a steel composition for seamless tubes having very good properties in terms both of creep rupture strength and of resistance to hot oxidation.

This composition has the commercial name VM12. It surprised the inventors with regard to the resistance to hot oxidation by steam at 600° C. and 650° C., which is very much greater than that of 9% Cr steels, even greater than that of X 20 Cr Mo V12-1 steel also containing 12% Cr and almost as good as that of the austenitic grade TP 347 FG containing 18% Cr.

Experimental results obtained at the Ecole des Mines de Douai were presented at the conference "High Temperature Corrosion and Protection of Materials 6", Les Embiez 2004, and were published in Materials Science Forum, Vol. 461-464 (2004), pp. 1039-1046, under the title "Steam Corrosion Resistance of New 12% Ferrite Boiler Steels".

The authors (V. Lepingle et al) observed that it is difficult quantitatively to predict hot oxidation kinetics, as the elements of the chemical composition of the steel can have a non-linear influence, or even operate synergistically.

Figure 2:
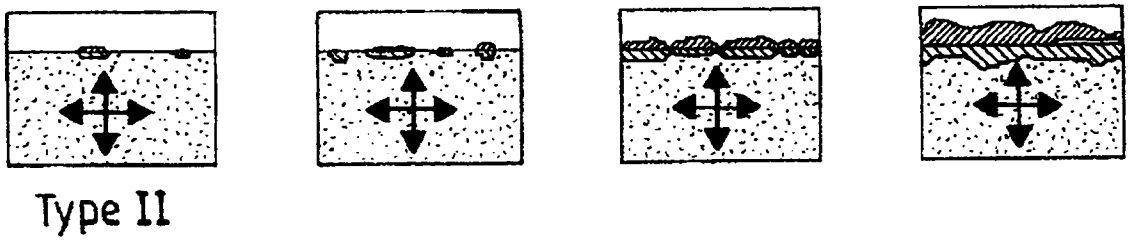
FIG. 2 illustrates schematically the development over time of a second oxidation mechanism, referred to in the present document as the "type-2" mechanism.

In particular, they revealed the existence of two different types of growth mechanisms occurring in hot oxidation, illustrated in FIGS. 1 and 2.

FIG. 1 illustrates the mechanism conventionally governing the hot oxidation of 9-12% Cr steels. As may be seen, the oxide forms homogeneously over the entire surface.

The mechanism of FIG. 2 relates to the VM 12 grade, to specific X20 Cr Mo V 12-1 steel compositions and to the austenitic TP 347 FG grade having fine grains: in this case, the oxide arises in the form of isolated seeds which have had to develop at the surface before forming a layer and developing in depth. This mechanism leads to slow oxidation kinetics and to adhesive mill scales.

Other studies are also interested in predicting the kinetics of hot oxidation by water vapour.

A communication from Zurek et al was also presented at the Les Embiez conference and published in "Materials Science Forum", Vol. 461-464 (2004), pp. 791-798. It shows qualitatively the influence of various chemical elements on the variation of the constant Kp of the law of empirical oxidation $$\Delta m = Kpt^z$$

wherein Δm is the increase in mass caused by oxidation and t is time, while z is generally taken to be equal to ½. The constant Kp displays a sudden decrease beyond a specific chromium content.

Figure 3:
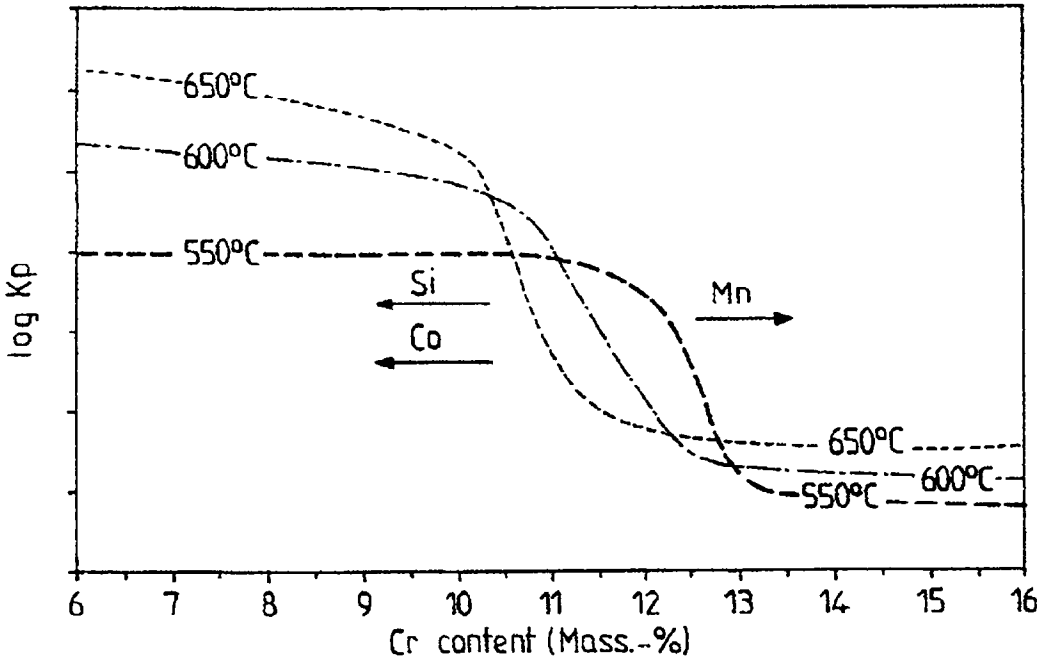
FIG. 3 is a graph illustrating properties of steel compositions.

The main conclusions which may be drawn from Zurek et al are as follows (see FIG. 3):

- the addition of manganese moves to the right the area in which there is a marked decrease in Kp, as a function of the chromium content; according to this study, the addition of Mn tends to impede the beneficial effect of the Cr;
- the addition of silicon or cobalt, by contrast, moves to the left the area in which there is a marked decrease in Kp, as a function of the chromium content. According to this study, Si and Co have a beneficial influence extending the field of action of the Cr.

It will be understood that it is difficult to derive therefrom precise information concerning the properties of any particular alloy.

Osgerby et al (S. Osgerby, A. Fry, "Assessment of steam oxidation behaviour of high temperature plant materials", Proceedings from the 4$^{th}$ International EPRI Conference, Oct. 25-28, 2004—Hilton Head Island, S.C.—pp. 388-401) also studied the oxidation of a broad range of steels and Ni alloys by water vapour. They carried out on the results a treatment with the aid of neural networks. They arrived at equations which, in the case of 9-12% Cr ferritic steels, quantitatively show a positive influence of Cr, Si, Mn and Mo and a negative influence of W.

Overall, the conclusions of these studies are diverse, and even contradictory with regard to the case of manganese in ferritic steels.

The Applicant sought to improve the situation, and in particular to obtain quantitative elements allowing an improvement in the existing steels, in particular those which contain 9% Cr and of which the oxidation resistance has hitherto been considered insufficient and those containing 2.25% Cr.

Experiments of the Applicant

The Ecole des Mines de Douai first of all developed, for a study contract with the Applicant, a formula for predicting the loss in metal thickness (determined after pickling of the oxide formed without etching of the metal) over one year from a modelling of the influence of all of the elements of the chemical composition.

This formula, known as the LPL (lowest protective layer of scale) formula, is not publicly available and its terms are not known to the Applicant.

The Applicant was easily able to note significant discrepancies between the experimental results and the results obtained by application of the LPL formula, of which it was advised.

The Applicant therefore retook the measurements of the kinetics of hot oxidation by water vapour at 650° C. presented at the Les Embiez 2004 conference (see above) on sixteen samples of steels which have a ferritic structure (ferrite+perlite, tempered bainite, tempered martensite) and the Cr content of which ranges from 2.25% (T22-T23) to 13%. FIG. 4 is a composition table of the steels tested with, in the last column, the values of the corrosion measurements corresponding to the loss in metal thickness over one year (corrosion rate Vcor) for these steels.

The term "NA" in the table of FIG. 4 means "not available".

The Applicant performed a multidimensional statistical analysis on these experimental results. The analysis was based on a plurality of terms conveying a reasoned empirical approach of specific mechanisms or influences determining the corrosion rate Vcor.

After a plurality of tests, the Applicant obtained appended Formula [21] which expresses the corrosion rate Vcor at 650° C. over the long term, that is to say, over a period of roughly one year.

Formula [21] provides the average loss in metal thickness (in mm) over one year of exposure to water vapour at 650° C. This average loss in thickness is itself deduced from a loss in weight of the metal after selective pickling of the oxide under standard conditions. Formula [21] comprises various specified terms as follows:

| Term | Represented influence |
|---|---|
| $1/Cr^2$ | represents mainly the influence of the chromium content, in this case a dependence which is the inverse of the square of the chromium content |
| 1/A | represents mainly the influence of the contents of molybdenum, tungsten, nickel and cobalt, taking into account an interaction with the chromium content |
| B | represents mainly the influence of the silicon content, in that case too taking into account an interaction with the chromium content |
| C | represents mainly the influence of the manganese content, taking into account interactions with the contents of tungsten and nickel |

The contents of Formula [21] are expressed in % by weight (or by mass).

The coefficients α (alpha), β (beta) and δ (delta) and those occurring in expressions B and C have substantially the values mentioned in Annex 1, Section 3, expressions [31] to [36].

That aside, if Formula [21] is examined globally, it would appear to comprise in particular:

- a function of the chromium content comprising a $1/Cr^2$ term with a 1/Cr rate term (term 1/A), and a Cr corrective term (term B);
- a polynomial function (in this case second-degree) of the manganese content (term C);
- a joint contribution (denoted by q) of W+Ni (tungsten+nickel) which is on the one hand a 1/−q contribution in the term A, and on the other hand a q contribution in the term C;
- the other contents occur only once, in a manner which is directly inferable from the formula.

Figure 5:
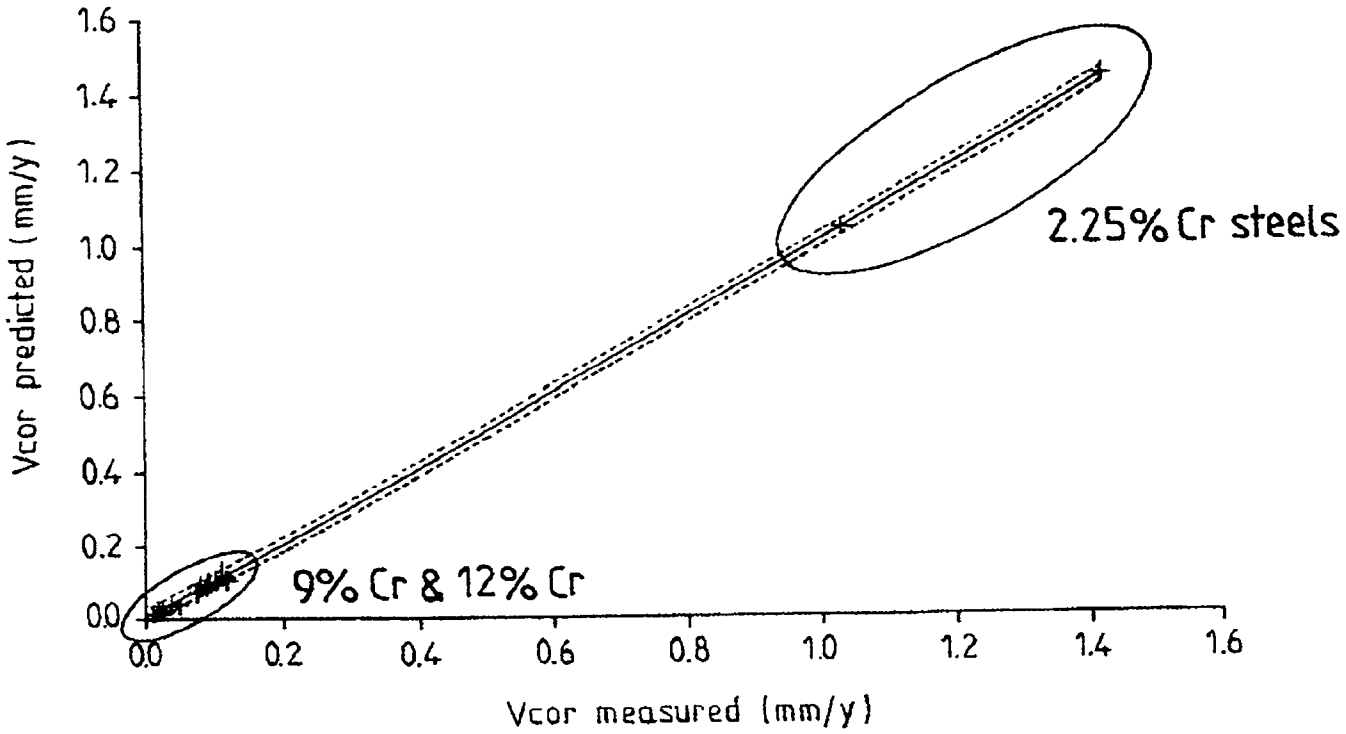
FIG. 5 is a graph representing a correspondence between measured data and calculated data.
Figure 6:
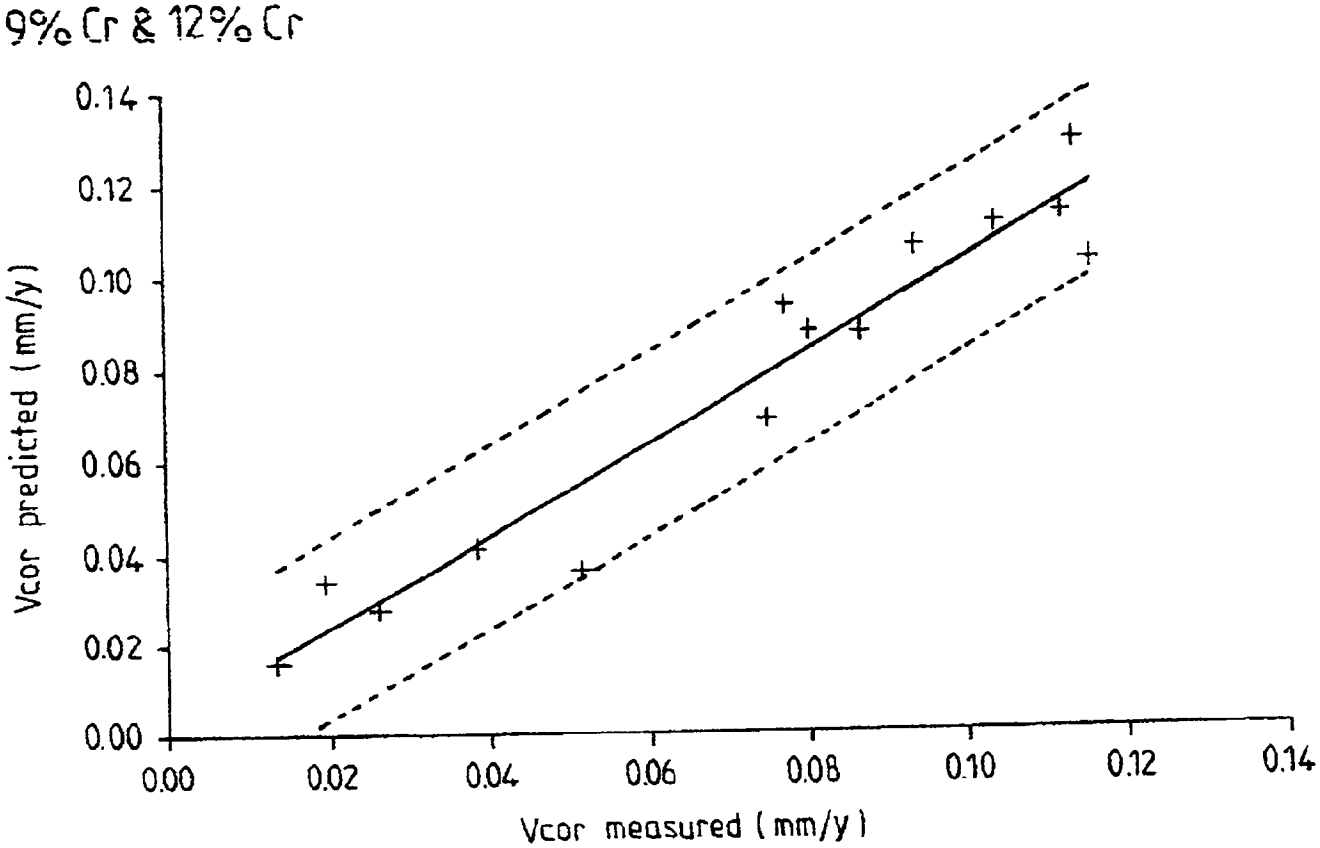
FIG. 6 is a graph forming a partial detail of FIG. 5.

FIGS. 5 and 6 illustrate how this new formula Vcor on the y axes (Vcor predicted) compares with the Applicant's known experimental results on the x axes (Vcor measured). It may be inferred from this:

- in FIG. 5 (right-hand part) that the correspondence is excellent for chromium contents in the region of 2.25%;
- in FIG. 5 (left-hand part), and also in FIG. 6 which is a detail of the left-hand part of FIG. 5, that the correspondence is also excellent for chromium contents in the region of 9% and 12%.

In brief, the modelling and the experiment provide remarkably similar results. Obviously, the invention is not limited to the expression of Formula [21], of which it is possible to write equivalents having a different rate. It is also possible to write simplified equivalents thereof, of more local use (in terms of ranges of contents), taking into account the properties of variation of each of the terms, or of their elements. Finally, although Formula [21] was drawn up at 650° C., it is of course valid for other, lower or higher temperatures. For example, a grade of steel having a corrosion rate somewhat higher at 650° C. may be acceptable at lower temperatures, if it has properties which are beneficial from any point of view, including a lower production cost.

More specifically, the Applicant noted a marked adverse influence of the Mn content above about 0.25%, in accordance with the information of Formula [21] (studied range of contents: 0.2-0.53%). It also noted that the Si content has little effect if Si is greater than or equal to 0.20% (studied range of contents: 0.09-0.47%). It also noted the absence of a significant influence of the carbon content within the studied limits (0.1-0.2%).

The Applicant was then interested in searching among the high-performance ferritic grades of the specifications ASTM, A213 and A335 for use in boilers (T91, P91, T92, P92, T23, P23, T24, P24) of the particular fields of chemical composition leading to thin and highly adhesive mill scales allowing the tubes to operate more effectively at steam temperatures of about 600°, even 650° C., and steam pressures of about 300 bar.

Generally, tube manufacturers have to date ordered their steel from the bottom of the chromium content ranges, given the cost of this element and the alphagenic nature of this element. For example, for a theoretical range of from 8.00 to 9.50% for the T91 grade of ASTM A213, tube manufacturers order a steel containing about 8.5% Cr; this minimises the risk of the presence of delta ferrite in the product.

It is known that manganese allows the sulphur content of the steel to be fixed, and that this fixing prevents forgeability problems (burning of the steel). Thus, whereas the range of ASTM A213 is from 0.30-0.60% for the grade T91, it is conventional to develop steels for use at high temperature having manganese contents in the range of 0.50%, i.e. from the top of this range.

Generally, the grades of steel proposed in the present document for seamless tubes intended to convey water vapour under elevated pressure and temperature comprise (by weight) 1.8 to 13% of chromium (Cr), less than 1% of silicon (Si) and between 0.10 and 0.45% of manganese (Mn). Optionally, the steel comprises an addition of at least 1 element selected from molybdenum (Mo), tungsten (W), cobalt (Co), vanadium (V), niobium (Nb), titanium (Ti), boron (B) and nitrogen (N).

In view of the experience which it had acquired, the Applicant focused on two groups of grades which display high creep performance, as they are alloyed with Mo or with W and microalloyed (Nb, V, N and optionally B and Ti), and are improvable from the point of view of hot oxidation. These are:

first group 2.25% Cr steels: grades T/P22, T/P23, T/P24 second group 9% Cr steels: grades T/P91, T/P92

Grades of special steels that are particularly advantageous in terms of corrosion rate were identified therefrom, as will be seen hereinafter.

EMBODIMENT E10

Steels T22 and P22

The standards ASTM A213 and A335 define respectively the grades T22 and P22 as containing:

0.30 to 0.60% Mn
at most 0.50% Si
1.90 to 2.60% Cr
0.87 to 1.13% Mo
0.05 to 0.15% C
at most 0.025% S
at most 0.025% P Old grades do not contain microadditions of Ti, Nb, V and B.

In the following Table T10, columns 2 to 7 specify the compositions for a reference steel from the field, and for three other proposed steels (designated in column 1). In the column Vcor measured, "NA" means "not available". It will be understood that the tests required to determine a reliable and precise corrosion rate at high temperature over one year are particularly long, awkward and expensive.

For the reference steel (R10), it may be seen that the measured value and the value predicted by Formula [21] correspond almost exactly. Once Formula [21] has thus been checked, information is derived therefrom concerning other grades of steel of this embodiment E10. These other grades are represented by three examples, denoted by E10-max, E10-med, and E10-min, in accordance with the corrosion rate obtained.

TABLE T10

| | Mn | Si | Cr | Mo | W | Ni | Co | Vcor measured | Vcor calculated |
|---|---|---|---|---|---|---|---|---|---|
| Reference (R10) | 0.46 | 0.23 | 2.06 | 1 | 0.014 | 0.15 | — | 1.035 | 1.04 |
| E10 - max | 0.45 | 0.20 | 2.30 | 1.0 | — | 0.2 | — | NA | 0.86 |
| E10 - min | 0.30 | 0.45 | 2.60 | 0.9 | — | 0.1 | — | NA | 0.61 |
| E10 - med1 | 0.40 | 0.20 | 2.30 | 1.0 | — | 0.2 | — | NA | 0.83 |
| E10 - med2 | 0.35 | 0.30 | 2.45 | 0.95 | — | 0.15 | — | NA | 0.70 |

The selection of the grades E10 allows a gain of between 18% (for E10-max) and 42% (for E10-min), relative to the corrosion rate of the "reference" composition R10.

In this embodiment E10, the steel comprises between 2.3 and 2.6% Cr.

Preferably, the steel of embodiment E10 comprises an Si content of between 0.20 and 0.50% and very preferably between 0.30 and 0.50%. Preferably, the steel comprises an Mn content of between 0.30 and 0.45%.

The steel according to this embodiment E10 comprises preferably between 0.87 and 1% Mo. It does not comprise a deliberate addition of W, the tungsten being a residual of the steel and its content about 0.01%.

Very preferably, the steel according to embodiment E10 has contents of Cr, Mn, Si, Mo, W, Ni, Co, of which the Vcor value, calculated in accordance with Equation [21], is at most equal to about 0.9 mm/year, preferably 0.85 mm/year. Better results are obtained for Vcor at most equal to about 0.7 mm/year.

EMBODIMENT E11

Steels T23 and P23

The standards ASTM A213 and A335 define respectively the grades T23 and P23 as containing:

0.10 to 0.60% Mn
at most 0.50% Si
1.90 to 2.60% Cr
0.05 to 0.30% Mo
1.45 to 1.75% W
0.04 to 0.10% C
at most 0.030% P
at most 0.010% S
0.20 to 0.30% V
0.02 to 0.08% Nb
0.0005 to 0.006% B
at most 0.030% of N
at most 0.030% of Al The replacement of a large part of the molybdenum with tungsten and the microadditions impart to these grades creep strength properties which are much improved over those of T/P22 grades. Such an improvement does not, by contrast, allow an increase in the upper limit of the temperature resistance with respect to hot oxidation.

In the following Table T11, columns 2 to 7 specify the compositions for a reference steel from the field, and for three other proposed steels (designated in column 1). For the reference steel, it may be seen that the measured value and the value predicted by Formula [21] correspond exactly. Once Formula [21] has thus been checked, information is derived therefrom concerning the other three grades of steel of this embodiment E11, denoted by E11-max, E11-med, and E11-min, in accordance with the corrosion rate obtained.

TABLE T11

| | Mn | Si | Cr | Mo | W | Ni | Co | Vcor measured | Vcor calculated |
|---|---|---|---|---|---|---|---|---|---|
| Reference (R11) | 0.48 | 0.24 | 2.07 | 0.10 | 1.54 | 0.05 | — | 1.43 | 1.43 |
| E11 - max | 0.45 | 0.20 | 2.30 | 0.20 | 1.60 | 0.10 | — | NA | 1.26 |
| E11 - min | 0.25 | 0.50 | 2.60 | 0.05 | 1.45 | 0.02 | — | NA | 0.70 |
| E11 - med1 | 0.40 | 0.20 | 2.30 | 0.10 | 1.60 | 0.10 | — | NA | 1.12 |
| E11 - med2 | 0.30 | 0.30 | 2.45 | 0.10 | 1.50 | 0.05 | — | NA | 0.84 |

The selection of the grades E11 allows a gain of between 12% (for E11-max) and 51% (for E11-min), relative to the corrosion rate of the "reference" composition.

In this embodiment E11, the steel comprises between 2.3 and 2.6% Cr.

Preferably, the steel of embodiment E11 comprises an Si content of between 0.20 and 0.50% and very preferably between 0.30 and 0.50%. Preferably, the steel comprises an Mn content of between 0.25 and 0.45%.

The steel according to this embodiment E11 comprises preferably between 1.45 and 1.60% W and between 0.05 and 0.20% Mo.

Very preferably, the steel according to embodiment E11 has contents of Cr, Mn, Si, Mo, W, Ni, Co, of which the Vcor value, calculated in accordance with Equation [21], is less than about 1.4 mm/year, preferably at most equal to about 1.25 mm/year. Better results are obtained for Vcor at most equal to about 0.9 mm/year.

EMBODIMENT E12

Steels T24/P24

These steels contain in accordance with the standard ASTM A213:

0.30 to 0.70% Mn
0.15 to 0.45% Si
2.20 to 2.60% Cr
0.70 to 1.10% Mo
0.04 to 0.10% C
at most 0.020% P
at most 0.010% S
0.20 to 0.30% V
0.06 to 0.10% Ti
0.0015 to 0.0020% B
at most 0.012% N
at most 0.020% Al The following Table T12 has been drawn up in a similar manner to Tables T10 and T11.

TABLE T12

| | Mn | Si | Cr | Mo | W | Ni | Co | Vcor measured | Vcor calculated |
|---|---|---|---|---|---|---|---|---|---|
| Reference (R12) | 0.50 | 0.25 | 2.30 | 0.85 | — | 0.05 | — | NA | 0.83 |
| E12 - max | 0.45 | 0.25 | 2.40 | 0.90 | — | 0.10 | — | NA | 0.76 |
| E12 - min | 0.30 | 0.45 | 2.60 | 0.70 | — | 0.02 | — | NA | 0.58 |
| E12 - med | 0.40 | 0.30 | 2.50 | 0.80 | — | 0.05 | — | NA | 0.67 |

The gain is more limited over the selection according to the invention: from 9% (E12-max) to 30% (E12-min). It is believed that that is basically due to the fact that the margin over the Cr content is less broad than for embodiment E10 or E11.

According to this embodiment E12, the steel comprises between 2.4 and 2.6% Cr. Preferably, the steel comprises an Si content of between 0.20 and 0.45% and very preferably between 0.30 and 0.45%. Preferably, the steel comprises an Mn content of between 0.30 and 0.45%.

The steel according to this embodiment E12 does not comprise an addition of W (residual tungsten content of about 0.01%); its Mo content is preferably between 0.70 and 0.9%.

Very preferably, the steel according to this embodiment E12 has contents of Cr, Mn, Si, Mo, W, Ni, Co, of which the Vcor value, calculated in accordance with Equation [21], is at most equal to about 0.8 mm/year and preferably at most equal to about 0.75 mm/year. Better results are obtained for Vcor at most equal to about 0.7 mm/year.

It will be noted that embodiments E10, E11 and E12 (denoted as a whole by E1) are quite similar, in terms of chromium, manganese and silicon content. Thus, other contents of Cr, Mn and/or Si of one of these embodiments E1 can be applied at least partially to another embodiment E1.

EMBODIMENT E20

Steels T9 and P9

The standards ASTM A213 and A335 define respectively the grades T9 and P9 as containing:

0.30 to 0.60% Mn
0.25 to 1.00% Si
8.00 to 10.00% Cr
0.90 to 1.10% Mo
at most 0.15% C
at most 0.025% P
at most 0.025% S Compared to embodiments E21 and E22 set out hereinafter, the steels according to embodiment E20 do not contain microadditions of V, Nb, N or B.

In the following Table T20, columns 2 to 7 specify the compositions for a reference steel from the field, and for three other proposed steels (designated in column 1). In the column Vcor measured, "NA" means "not available". It will be understood that the tests required to determine a reliable and precise corrosion rate at high temperature over one year are particularly long, awkward and expensive.

Information was derived from Formula [21] concerning various grades of steel of this embodiment E20. These grades are represented by three examples, denoted by E20-max, E20-med, and E20-min, in accordance with the corrosion rate obtained.

The selection of the grades E20 allows a gain of between 16% (for E20-max) and 89% (for E20-min), relative to the corrosion rate of the "reference" composition R20.

In this embodiment E20, the steel comprises between 9.2 and 10.00% Cr.

Preferably, the steel of embodiment E20 comprises an Si content of between 0.20 and 0.50% and very preferably between 0.30 and 0.40%. Preferably, the steel comprises an Mn content of between 0.30 and 0.45%.

The steel according to this embodiment E20 comprises preferably between 0.90 and 1.00% Mo. It does not comprise a deliberate addition of W, the tungsten being a residual of the steel and its content about 0.01%.

Very preferably, the steel according to embodiment E20 has contents of Cr, Mn, Si, Mo, W, Ni, Co, of which the Vcor value, calculated in accordance with Equation [21], is at most equal to about 0.09 mm/year, preferably 0.06 mm/year. Better results are obtained for Vcor at most equal to about 0.04 mm/year.

EMBODIMENT E21

Steels T91/P91

These steels contain in accordance with the standards ASTM A213 and A335:

0.30 to 0.60% Mn
0.20 to 0.50% Si
8.00 to 9.50% Cr
0.85 to 1.05% Mo
at most 0.40% Ni
0.08 to 0.12% C
at most 0.020% P
at most 0.010% S
0.18 to 0.25% V
0.06 to 0.1% Nb
0.030 to 0.070% N
at most 0.040% Al

TABLE T20

| | Mn | Si | Cr | Mo | W | Ni | Co | Vcor measured | Vcor calculated |
|---|---|---|---|---|---|---|---|---|---|
| Reference (R20) | 0.50 | 0.30 | 8.50 | 0.95 | 0.01 | 0.15 | — | NA | 0.137 |
| E20 - max | 0.45 | 0.25 | 9.20 | 1.00 | 0.01 | 0.2 | — | NA | 0.089 |
| E20 - min | 0.30 | 0.45 | 10.00 | 0.90 | 0.01 | 0.02 | — | NA | 0.012 |
| E20 - med1 | 0.35 | 0.40 | 9.60 | 0.95 | 0.01 | 0.15 | — | NA | 0.034 |
| E20 - med2 | 0.40 | 0.35 | 9.40 | 0.95 | 0.01 | 0.15 | — | NA | 0.060 |

The following Table T21 has been drawn up in a similar manner to Table T10.

TABLE T21

| | Mn | Si | Cr | Mo | W | Ni | Co | Vcor measured | Vcor calculated |
|---|---|---|---|---|---|---|---|---|---|
| Reference (R21) | 0.46 | 0.31 | 8.73 | 0.99 | 0.01 | 0.26 | — | 0.094 | 0.106 |
| E21 - max | 0.45 | 0.3 | 8.90 | 0.95 | — | 0.20 | — | NA | 0.095 |
| E21 - min | 0.30 | 0.50 | 9.50 | 0.85 | — | 0.02 | — | NA | 0.021 |
| E21 - med | 0.40 | 0.35 | 9.00 | 0.90 | — | 0.05 | — | NA | 0.066 |

The gain over the selection of these embodiments E21 ranges from 10% (E21-max) to 80% (E21-min). It is noteworthy that, for E21-min, the value obtained is five times less than the reference value.

According to this embodiment E21, the steel comprises between 8.9 and 9.5% Cr.

Preferably, the steel comprises an Si content of between 0.20 and 0.50% and very preferably between 0.30 and 0.50%.

Preferably, the steel comprises an Mn content of between 0.30 and 0.45%. It preferably comprises between 0.85% and 0.95% Mo.

Preferably, the steel according to embodiment E21 comprises at most 0.2% Ni (and very preferably at most 0.1%), and almost no tungsten (residual of about 0.01%).

Very preferably, the steel according to embodiment E21 has contents of Cr, Mn, Si, Mo, W, Ni, Co, of which the Vcor value, calculated in accordance with Equation [21], is less than about 0.1 mm/year. Better results are obtained for Vcor at most equal to about 0.07 mm/year.

EMBODIMENT E22

Steels T92/P92

These steels contain in accordance with the standards ASTM A213 and A335:

at most 0.30 to 0.60% Mn
at most 0.50% Si
8.50 to 9.50% Cr
0.30 to 0.60% Mo
1.50 to 2.00% W
at most 0.40% Ni
0.07 to 0.13% C
at most 0.020% F
at most 0.010% S
0.15 to 0.25% V
0.04 to 0.09% Nb
0.001 to 0.006% B
0.030 to 0.070% N
at most 0.040% Al The following Table T22 has been drawn up in a similar manner to Table T10.

TABLE T22

| | Mn | Si | Cr | Mo | W | Ni | Co | Vcor measured | Vcor calculated |
|---|---|---|---|---|---|---|---|---|---|
| Reference (R21) | 0.41 | 0.22 | 8.51 | 0.44 | 1.69 | 0.13 | — | 0.113 | 0.113 |
| E22 - max | 0.40 | 0.25 | 8.90 | 0.45 | 1.70 | 0.20 | — | NA | 0.11 |
| E22 - min | 0.30 | 0.50 | 9.50 | 0.30 | 1.50 | 0.02 | — | NA | 0.055 |
| E22 - med | 0.35 | 0.30 | 9.20 | 0.40 | 1.70 | 0.1 | — | NA | 0.082 |

In this case, the gain over the selection of these embodiments E22 ranges from 2% (E22-max) to 52% (E22-min).

According to this embodiment E22, the steel comprises between 8.9 and 9.5% Cr.

Preferably, the steel of embodiment E22 comprises an Si content of between 0.20 and 0.50% and very preferably between 0.30 and 0.50%.

Preferably, the steel of embodiment E22 comprises an Mn content of between 0.30 and 0.45% and more preferably between 0.30 and 0.40%.

The steel according to embodiment E22 comprises preferably between 0.30% and 0.45% Mo. It comprises between 1.50 and 1.75% W.

Preferably, the steel according to embodiment E22 comprises at most 0.2% Ni and very preferably at most 0.1%.

Very preferably, the steel according to embodiment E22 has contents of Cr, Mn, Si, Mo, W, Ni, Co which, in accordance with Equation [21], provide a value Vcor at most equal to about 0.11 mm/year. Better results are obtained for Vcor at most equal to about 0.08 mm/year.

It will be noted that embodiments E21 and E22 (denoted as a whole by E2) are quite similar, in terms of chromium, manganese and silicon content. Thus, the other contents of Cr, Mn and/or Si of one of these embodiments E2 can be applied at least partially to the other.

An intermediate situation will now be considered.

EMBODIMENT E30

Steels T5 and P5

The standards ASTM A213 and A335 define respectively the grades T5 and P5 as containing:

0.30 to 0.60% Mn
at most 0.50% Si
4.00 to 6.00% Cr
0.45 to 0.65% Mo
at most 0.15% C
at most 0.025% P
at most 0.025% S In the following Table T30, columns 2 to 7 specify the compositions for a reference steel from the field, and for three other proposed steels (designated in column 1). In the column Vcor measured, "NA" means "not available". It will be understood that the tests required to determine a reliable and precise corrosion rate at high temperature over one year are particularly long, awkward and expensive.

Information was derived from Formula [21] concerning various grades of steel of this embodiment E30. These grades are represented by three examples, denoted by E30-max, E30-med, and E30-min, in accordance with the corrosion rate obtained.

TABLE T30

| | Mn | Si | Cr | Mo | W | Ni | Co | Vcor measured | Vcor calculated |
|---|---|---|---|---|---|---|---|---|---|
| Reference (R30) | 0.50 | 0.32 | 4.80 | 0.52 | 0.01 | 0.15 | — | NA | 0.269 |
| E30 - max | 0.45 | 0.25 | 5.20 | 0.60 | 0.01 | 0.2 | — | NA | 0.228 |
| E30 - min | 0.30 | 0.45 | 6.00 | 0.45 | 0.01 | 0.1 | — | NA | 0.122 |
| E30 - med1 | 0.40 | 0.30 | 5.40 | 0.55 | 0.01 | 0.15 | — | NA | 0.189 |
| E30 - med2 | 0.35 | 0.30 | 5.60 | 0.50 | 0.01 | 0.15 | — | NA | 0.159 |

The selection of the grades E30 allows a gain of between 15% (for E30-max) and 55% (for E30-min), relative to the corrosion rate of the "reference" composition R30.

In this embodiment E30, the steel comprises between 5.2 and 6.00% Cr.

Preferably, the steel of embodiment E30 comprises an Si content of between 0.25 and 0.50% and very preferably between 0.30 and 0.45%. Preferably, the steel comprises an Mn content of between 0.30 and 0.45%.

The steel according to this embodiment E30 comprises preferably between 0.45 and 0.60% Mo. It does not comprise a deliberate addition of W, the tungsten being a residual of the steel and its content about 0.01%.

Very preferably, the steel according to embodiment E30 has contents of Cr, Mn, Si, Mo, W, Ni, Co, of which the Vcor value, calculated in accordance with Equation [21], is at most equal to about 0.23 mm/year, preferably 0.20 mm/year. Better results are obtained for Vcor at most equal to about 0.17 mm/year.

The model used leads to an increase in the content of specific alphagenic elements such as Cr, Si and to a reduction in the content of specific gammagenic elements such as Mn and Ni; this can promote the appearance of delta ferrite.

If the reduction in the content of Mo and/or W (alphagenic elements) is insufficient to compensate for the increase in the content of Cr, Si and the reduction in that of Mn and Ni from the point of view of the appearance of delta ferrite, it will be necessary to adjust the content of gammagenic elements such as N and C which do not occur in the present model. Use will be made in this regard of the known formulae for predicting delta ferrite as a function of the contents of equivalent chromium and equivalent nickel.

The technique proposed for optimising special steels includes the following elements. The starting point taken is a known grade of steel which has known properties other than hot corrosion and is to be optimised from the point of view of hot corrosion. A long-term corrosion property is calculated based on a model such as that of Formula [21] on a reference composition. A search is conducted within the vicinity of the known steel for a particular range of the composition of the grade of steel leading to a better value of the corrosion property based on the same model.

Since the model is highly reliable, this technique has numerous advantages including:

- avoiding the production of unusual steels only for corrosion tests;
- avoiding awkward and costly long-term and high-temperature corrosion tests.

Above all, this technique allows use to be made of the targeted data, which are not excessively pessimistic, for designing boilers or steam pipes and accordingly the excess corrosion thickness, which is taken into account in the design calculations, to be minimised.

It also allows the steam temperature to be increased to a given metal temperature and mill scale exfoliations to be avoided by promoting the heterogeneous and discontinuous formation of the oxide at the surface of the steel on the steam side.

The steel according to the invention can also be used, without the list being exhaustive, as a metal sheet for producing welded tubes, connections, reactors, boiler-making parts, as a moulded part for producing turbine bodies or safety valve bodies, as a forged part for producing shafts and turbine rotors, connections, as a metallic powder for producing a broad range of components in powder metallurgy, as a welding filler metal and other similar applications.

Annexe 1

Section 1

$$\sigma = P\frac{(D-e)}{2e} \tag{11}$$

Section 2

$$V_{COR}^{650°C.} = \alpha\frac{1}{Cr^2} + \beta\frac{1}{A} + \delta B + C \tag{21}$$

Section 3

$$\text{Alpha}=2.828 \tag{31}$$

$$\text{Beta}=0.237 \tag{32}$$

$$A=Cr—(Mo+W+Ni+Co) \tag{33}$$

$$\text{Delta}=0.091 \tag{34}$$

$$B=1.40-0.12*Cr+0.007/Si \tag{35}$$

$$C=1.2*Mn*Mn-0.53*Mn+0.02*(W+Ni)-0.012 \tag{36}$$

The invention claimed is:

1. A steel composition comprising chromium (Cr), manganese (Mn), silicon (Si), molybdenum (Mo), tungsten (W), nickel (Ni), cobalt (Co) such that the content by weight of each component satisfies at least one relationship selected from the group consisting of 1 and 2 in the Table below:

| | | 1 | 2 |
|---|---|---|---|
| according to specifications ASTM A213 and A335 defining respectively grades . . . | | T22/P22 | T92/P92 |
| comprising (in % by weight) | chromium (Cr) | 2.3-2.6 | 8.9-9.5 |
| | manganese (Mn) | 0.20-0.45 | 0.3-0.45 |
| | silicon (Si) | ≤0.5 | ≤0.5 |
| | molybdenum (Mo) | 0.87-1 | 0.3-0.45 |
| | Nickel (Ni) | 0.1-0.2 | 0.02-0.20 |
| | Vanadium (V), Titanium (Ti), and Boron (B) | No voluntary addition | |
| | tungsten (W) | ≤0.01 | 1.5-1.75 |
| being such that the corrosion value Vcor is | | ≤0.9 | ≤0.08 |

wherein said corrosion value Vcor is calculated based on the following Equation (21)

$$V_{COR}^{650°C.} = \alpha\frac{1}{Cr^2} + \beta\frac{1}{A} + \delta B + C \quad (21)$$

wherein the variable in Equation (21) are defined in Equations (31) to (36):

$$\text{Alpha}=2.828 \quad (31)$$

$$\text{Beta}=0.237 \quad (32)$$

$$A=Cr—(Mo+W+Ni+Co) \quad (33)$$

$$\text{Delta}=0.091 \quad (34)$$

$$B=1.40-0.12*Cr+0.007/Si \quad (35)$$

$$C=1.2*Mn*Mn-0.53*Mn+0.02*(W+Ni)-0.012 \quad (36)$$

2. The steel composition according to claim 1, wherein said steel composition comprises silicon in an amount at least equal to 0.30 wt %.

3. The steel composition according to claim 1, wherein said steel composition satisfies feature of group 1 in the table of claim 1 and wherein it comprises manganese in an amount at least equal to 0.25 wt %.

4. The steel composition according to claim 1, wherein said steel composition satisfies features of group 1 in the table of claim 1 and wherein the corrosion value Vcor is at most equal to 0.85.

5. A seamless tube or an accessory tube, comprising a steel composition according to claim 1.

6. A method of manufacturing a seamless tube or an accessory tube comprising applying a steel composition according to claim 1 to said tube.

7. The steel composition according to claim 1, wherein said steel composition satisfies feature of group 1 in the table of claim 1.

8. The steel composition according to claim 1, wherein said steel composition satisfies feature of group 2 in the table of claim 1.

* * * * *